US011628326B2

(12) United States Patent
Osuna

(10) Patent No.: US 11,628,326 B2
(45) Date of Patent: Apr. 18, 2023

(54) ADJUSTABLE RESISTANCE BAND AND METHOD OF USE THEREOF

(71) Applicant: Bryan Osuna, Redwood City, CA (US)

(72) Inventor: Bryan Osuna, Redwood City, CA (US)

( * ) Notice: Subject to any disclaimer, the term of this patent is extended or adjusted under 35 U.S.C. 154(b) by 0 days.

(21) Appl. No.: 16/862,435

(22) Filed: Apr. 29, 2020

(65) Prior Publication Data

US 2022/0257991 A1 Aug. 18, 2022

(51) Int. Cl.

| | |
|---|---|
| ***A63B 21/055*** | (2006.01) |
| ***A63B 21/00*** | (2006.01) |
| ***A63B 21/04*** | (2006.01) |
| ***A63B 23/04*** | (2006.01) |
| ***A63B 23/02*** | (2006.01) |

(52) U.S. Cl.

CPC .... *A63B 21/0557* (2013.01); *A63B 21/00069* (2013.01); *A63B 21/04* (2013.01); *A63B 23/0205* (2013.01); *A63B 23/0488* (2013.01); *A63B 21/4011* (2015.10)

(58) Field of Classification Search

CPC ..... A63B 21/00069; A63B 21/04; A63B 21/0557; A63B 21/02; A63B 21/028; A63B 21/0428; A63B 21/0442; A63B 21/05; A63B 21/055; A63B 21/0552; A63B 21/0555; A63B 21/4011; A63B 21/4013; A63B 21/4015; A63B 21/4017; A63B 21/4019; A63B 21/4021; A63B 21/4023; A63B 21/4025; A63B 23/0205; A63B 23/0488; A63B 2023/006

See application file for complete search history.

(56) References Cited

U.S. PATENT DOCUMENTS

| | | | | |
|---|---|---|---|---|
| 5,308,305 | A | 5/1994 | Romney | |
| 5,848,956 | A | 12/1998 | Grettner | |
| 5,938,572 | A | 8/1999 | Spano | |
| 8,012,071 | B2 * | 9/2011 | Grisdale | A63B 21/0552 482/125 |
| 8,771,155 | B1 | 7/2014 | Bell | |
| D712,555 | S | 9/2014 | Berg | |
| 8,932,190 | B2 | 1/2015 | Moore | |
| D750,716 | S | 3/2016 | Pouliot | |
| 9,656,115 | B2 * | 5/2017 | Young | A63B 21/4043 |
| 9,907,389 | B2 | 3/2018 | Conlin | |
| D850,546 | S | 6/2019 | Reese | |
| 2004/0067827 | A1 | 4/2004 | Tustin | |
| 2018/0318630 | A1 * | 11/2018 | Young | A63B 21/0428 |
| 2019/0201731 | A1 * | 7/2019 | Nguyen | A63B 21/4015 |
| 2019/0351278 | A1 * | 11/2019 | Walker | A63B 21/00061 |
| 2021/0038939 | A1 * | 2/2021 | Maekawa | A63B 21/4034 |

FOREIGN PATENT DOCUMENTS

| | | | | |
|---|---|---|---|---|
| GB | 2596604 | * | 3/2020 | A63B 21/00 |

* cited by examiner

*Primary Examiner* — Megan Anderson
(74) *Attorney, Agent, or Firm* — Sue. C. Watson

(57) ABSTRACT

An adjustable resistance band for exercise or physical therapy apparatus including a webbing hook component, strap and slots with openings for adjustability in which the band is easily secured around the user's legs or torso by placing the webbing hook in one of the loop openings.

8 Claims, 6 Drawing Sheets

ADJUSTABLE RESISTANCE BAND AND METHOD OF USE THEREOF

FIELD OF THE INVENTION

The present invention relates generally to an adjustable resistance band and, more specifically, to an adjustable resistance band with a webbing hook and one or more slots adapted to receive the webbing hook for adjusting the resistance band for exercise. The present invention also relates to a method of using said adjustable resistance band.

BACKGROUND OF THE INVENTION

Sitting, lack of activity, improper exercise and a generally sedentary lifestyle result in important muscles becoming weak and atrophied. Some of these muscles include the gluteal muscles, the diaphragm and the abdominal muscles. When these muscles become weak and undeveloped, the body may become more susceptible to injury, dysfunction, deterioration and disease. Similarly, when these important muscles are weak or undeveloped, athletes may experience higher rates of injury.

Existing bands may be used to introduce extra resistance to a plurality of body parts during exercise.

Similar resistance bands are commonly used for physical therapy and by people with physical limitations.

These existing bands however have a fixed shape as a closed-loop resistance band system (loop/circle) or non-looped resistance band system (straight with two ends).

Loop products are challenging to put on and take off of the body and existing bands are dangerous to use because they can catch on the user's feet while they are stepping into them, causing them to trip and fall or strain their body. Those with injuries such as back injuries are often unable to bend forward enough to put these bands on. Moreover, the loop products are not designed for use around the torso.

Furthermore, loop products have limited versatility because they cannot be used in many of the ways that straight bands can. Even further, existing loop products are not adjustable in length or resistance strength or may feature adjustability that is challenging to use.

Existing straight bands may be converted into a closed loop by tying them in a knot. This method may be unreliable, tedious and frustrating to users.

Many existing products are made from materials that rip easily, are uncomfortable to the skin, or have a tendency to bunch up or move around during use.

Lastly, weightlifting belts do not have elasticity and therefore do all the supporting work of the core muscles, which can actually make the core muscle weaker while the rest of the body gets stronger.

U.S. Pat. No. 5,848,956 discloses a lat sling kit for exercising, the lat sling kit including a connective band separating a uniform pair of loops, a pair of U-shaped forearm belts, and a pair of assemblies, each comprised of an inner shell and an outer skin.

The sling may be attached via releasable surface means to a standard lat-bar, or typical pull-bar, and suspended therefrom wherein to exercise the latissimus dorsi, a user places each forearm through its respective loop, and with that forearm flexed, a portion of the user's arm-elbow-forearm may reside within the shell and skin assembly.

With both appendages thus encased, and resistance against the back of each upper arm, the user may then begin exercise by extending or adducting the arm.

U.S. Pat. D850546 discloses a design of an elastic fitness band having oval segments and rings interspersed along the length of said elastic fitness band.

U.S. patent application Publication Ser. No. 10/678,785 discloses an apparatus for exercising the human body, said apparatus consisting of an elastic natural gum rubber band formed in a closed loop and in which the apparatus may be provided in a variety of lengths, thicknesses and widths to suit the size and muscular strength of the user.

U.S. Pat. No. 8,771,155B1 discloses an exercise apparatus that may comprise first and second arm cuffs and a central elastic member wherein the first and second arm cuffs may be configured to encircle right and left arms, respectively, of an exerciser. Each arm cuff may be configured to encircle an elbow of the arm, a portion of an upper arm of the arm, and a portion of a lower arm of the arm. The first and second arm cuffs may be attached to opposite sides in a longitudinal direction of the central elastic member. The central elastic member may have a substantially rectangular shape and may have a length sufficient to extend across a chest of the exerciser and for the first and second arm cuffs to encircle the right and left arms, respectively, of the exerciser.

U.S. Pat. No. 9,907,389B2 discloses a hammock strap that may include an elongated length of strap material that may be separated into a first strap and a second strap. The first strap and the second strap may be woven together at one or more separation points to form sections between the first strap and the second strap.

U.S. Pat. No. 5,938,572A discloses a weight resistance exercise training device for placement above the knee. Said weight resistance exercise training device may include a pair of flexible side compartments containing weight material, a central flexible compartment containing weight material adapted to be engaged across a person's limb and interconnecting the side compartments, whereby the side compartments may depend from the person's limb when the central compartment is engaged across the limb, each side compartment having an underside; and, a strap secured to each side compartment underside where the side compartments are interconnected to the central compartment and provided with fasteners for attachment of the straps together and securement of the device to the person's limb.

U.S. Pat. No. 8,932,190B2 discloses an apparatus for facilitating exercising, wherein said apparatus may include a first thigh wrap, a second thigh wrap and a first elastic resistance wrap coupled about the first thigh wrap and the second thigh wrap, with the first elastic resistance wrap being substantially elongated.

Various attempts have been made to solve problems found in existing products. Among these are found in: U.S. Pat. No. D750,716S1; U.S. Pat. No. D712555; and U.S. Pat. No. 5,308,305A. This prior art is representative of resistance bands.

Some of these inventions are un-looped bands that cannot be converted into a loop. Others are fixed as a loop, cannot be converted into an open band and may not have the ability to adjust in length and/or are inelastic dangerous to use as they can cause people to trip and fall when putting them on and taking them off their legs since users may need to put their feet through the closed loop devices to get them on, a challenging and dangerous activity for many people.

None of the above inventions and patents, taken either individually or in combination, is seen to describe the invention as claimed. Thus, a need exists for an adjustable resistance band that is specifically designed for safer and easier usage by allowing the user to perform effective exercise while avoiding the above-mentioned problems.

SUMMARY OF THE INVENTION

Existing limitations associated with the foregoing, as well as other limitations, can be overcome by the use of an adjustable resistance band with a webbing hook and one or more slots disposed along the length of adjustable resistance band and adapted to receive the webbing hook for adjusting the adjustable resistance band for exercise.

In an aspect herein, an adjustable resistance band may be provided that includes: a strap made of substantially elastic material, said strap having a proximal end and a distal end; a webbing hook having an enclosed window opening, said webbing hook attached to the proximal end of the strap and adapted with a ridge that is connected to a base segment by a connecting segment; and one or more slots disposed along the length of the strap at defined intervals, wherein each of the one or more slots has an opening for receiving the ridge of the webbing hook in order to adjust a working size of the adjustable resistance band.

In another aspect the adjustable resistance band may include one or more of the following configurations: (i) the webbing hook is attached to the strap through the enclosed window opening, (ii) the one or more slots are dimensioned to be substantially parallel to a longitudinal profile of the adjustable resistance band, (iii) the one or more slots are dimensioned to be substantially perpendicular to a longitudinal profile of the adjustable resistance band, (iv) the webbing hook has a lock disposed on one end of the connecting segment and adjustable to be received or locked into place by a proximal end of the ridge in order to prevent the webbing hook from being accidentally removed from the slot during exercise, (v) the slots are loops that are created by sewing or stitching said strap onto itself or sewing or stitching another strap onto said strap at one or a plurality of defined locations, (vi) the adjustable resistance band is configured to be used in an open loop configuration or in a closed loop configuration, or (vii) the strap comprises one or more rubber tubes which are attached to the webbing hook at the proximal end and to a slot at the distal end.

In another aspect herein, a method of using an adjustable resistance band the method may be provided. The method may include: providing a strap made substantially of elastic material, said strap having a proximal end and a distal end; providing a webbing hook having an enclosed window opening, said webbing hook is attached to the proximal end of the strap and adapted with a ridge that is connected to a base segment by a connecting segment; providing one or more slots disposed along the length of the strap at defined intervals, and adjusting a working size of the adjustable resistance band by inserting the ridge into the one or more slots.

In yet another aspect, the method may include using the adjustable resistance band for strengthening muscles of the thigh or torso.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The adjustable resistance band may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein and wherein.

Figure 1A:
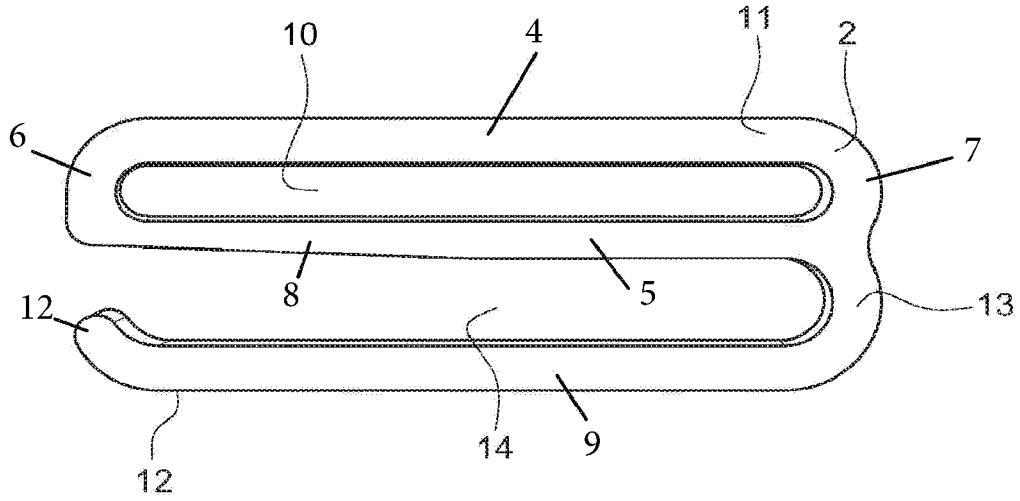
FIG. 1A is side view of webbing hook according to an exemplary embodiment of the present invention.

The different figures may have at least some reference numerals that may be the same in order to identify the same components, although a detailed description of each such component may not be provided below with respect to each Figure.

DETAILED DESCRIPTION OF THE INVENTION

In accordance with example aspects described herein an adjustable resistance band may have a webbing hook and one or more slots adapted to receive the webbing hook for adjusting the resistance band for exercise. The adjustable resistance band may be changeable from a closed loop in which a plurality of exercises may be performed, to an open loop, in which another plurality of exercises may be performed.

The adjustable resistance band and a method of using said adjustable resistance band are described hereinafter.

Referring generally to the Figures, a device intended for use in physical activities is shown as an adjustable resistance band 100 having an integrated biofeedback construction (construction that provides kinesthetic cues to a user in order to bring awareness to a specific body part or movement through physical contact) configured to enable easy and safe adjustment of the resistance band as well as to provide optimal biomechanics. Exhibiting sub-optimal biomechanics may increase a person's risk of injury and may impair their performance of exercises (e.g., athletic, postural and rehabilitative activities, etc.). The biofeedback properties of the adjustable resistance band 100 may sense and correct sub-optimal biomechanical position of a user during exercise. When a user demonstrates sub-optimal biomechanical position, the band 100 may respond by providing counteractive force/feedback that indicates to the user that their biomechanical position is sub-optimal and that indicates to the user how to adjust their body towards a more optimal biomechanical position in order to achieve optimal biomechanical motion. The feedback provided may be related to (e.g., is substantially proportional to) the magnitude of the correction required for the user to achieve an optimal biomechanical motion. In this manner, the adjustable resistance band may reduce a user's risk of injury and improve their performance (e.g., making the physical exercise more efficient.).

"Exercise" as used herein is intended to include both static and dynamic activities. For example, a device as disclosed herein may address breathing activities of a user through engagement of the user's torso, or may address a user's movement or dynamic posture during any number of dynamic activities (e.g., squats, stretching, jumping, rehabilitative activities, etc.). Further, as used herein, a "biomechanical position" can be a static position or a dynamic position (e.g., motions, movement, etc.), and a "posture" can be a static posture or a dynamic posture.

"Optimal" biomechanical motion is related to optimal dynamic posture wherein dynamic posture is be the ability of a person to maintain an optimal instantaneous axis of rotation or line of gravity in any combination of movement planes at any time in space. Dynamic posture is important because it is related to the ability of a person to produce force. Each biomechanical motion is a series of dynamic postures. Successful movement is generally determined by the ease of transition from each posture to the next and the continual maintenance of the body's equilibrium or balance.

A person's risk of injury may substantially increase when the person's biomechanical motion includes sub-optimal dynamic postures. Each dynamic posture during movement is a momentary alignment of body portions or segments. If one body segment or portion (e.g., "link") in the kinetic chain is out of sync, there is potential for a performance error, weakness or injury. For example, when body segments or portions are misaligned, such as at the knee joint, it can result in extra torque or force (e.g., sheer force, compressive force, etc.) on the tissues, as well as a decrease in the structural integrity of the joint. Ultimately, this can lead to instability, weakness, injury and deterioration of the joint. When the segments and/or portions of a person's body are aligned, the person typically has better balance, coordination and strength.

For the purposes of this disclosure, body segments are generally defined as portions of the body defined generally between two joints. It should be noted that body segments do not operate independently; the movement of one body segment inevitably affects the position and movement of another. Also, for the purposes of this disclosure, a body portion is any part or combination of parts of the body including, body segments, joints, muscles, tendons, organs, etc.

A person's performance and movement also suffers when their biomechanics include sub-optimal dynamic postures because, all else being equal, performing a physical activity with sub-optimal biomechanical motion is typically less efficient than performing a physical activity with optimal biomechanical motion. A person performing a given activity with sub-optimal biomechanical motion expends more energy than when performing that same activity with optimal biomechanical motion. When a person performs a physical activity with sub-optimal biomechanics, the person may move in a more laborious and energy intensive manner as they are working harder to overcome increased instability, weakness and resistance in their joints. Further, the person may become fatigued sooner and unable to recover as quickly from physical exertion because more energy than is necessary is expended.

According to an exemplary embodiment of the present invention, the feedback provided to the user is in the form of counteractive or resistive forces. These forces not only act as a cue to help the user correct position or maintain proper position, but it also provides resistance training to help strengthen the muscles that are responsible for maintaining proper alignment and function. Proprioception is a person's awareness of their alignment, movement, equilibrium, and position, as well as the user's awareness of where the various parts of their body are in relation to each other while the neuromuscular system invokes the muscles and nervous system to work together to achieve movement.

Proprioception utilizes proprioceptors, which are sensory receptors in a person's body that respond to joint movement and joint position, but do not typically contribute to conscious sensation. These sensory receptors mediating proprioception are found throughout a person's body, (e.g., in the skin, muscles, joints, ligaments, tendons, etc.). Accordingly, sensory receptors (e.g., proprioceptors) in the user's body sense the forces provided by the biofeedback properties of the adjustable resistance band, sending information to the user's brain. The user's brain may process this information rapidly, substantially without the user realizing it. In response, the user's brain activates their neuromuscular system, moving the muscles according to the stimulus provided by the feedback forces. Generally, this responsive movement (e.g., adjustment, etc.) of the person's body occurs subconsciously.

Adjustable Resistance Band

Figure 1B:
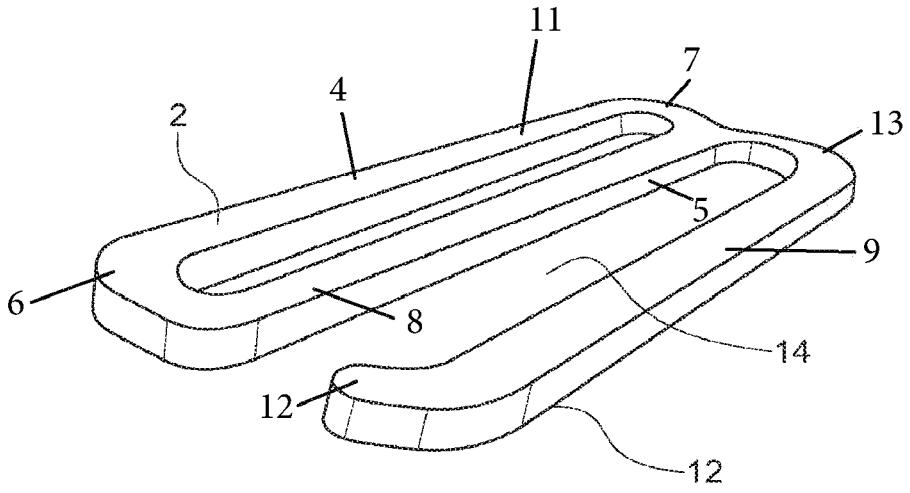
FIG. 1B is a perspective view of webbing hook according to an exemplary embodiment of the present invention.

Reference will now be made to FIGS. 1A and 1B, which shows a webbing connector or webbing hook 2 according to at least some embodiments of the present invention.

The webbing hook 2 may comprise a base segment 11 which includes an elongated first rod 4 spaced-apart from an elongated second rod 5. The first rod 4 and the second rod 5 are connected together by first and second curved ends 6, 7, respectively. A window opening 10 is defined by the spaced-apart elongated first and second rods 4, 5 and their curved ends 6, 7, respectively. The elongated first rod 4 desirably has a length and a symmetrical width, and the second rod 5 desirably has a length similar to the length of the first rod 4, but the second rod 5 has a tapered width 8. That is, the width or the second rod 5 is wider near the second curved end 7 but tapers to become narrower near the first curved end 6. A third rod 9 is spaced apart from the second rod 5 and is connected thereto via a third curved end or a connecting segment 13. The third rod 9 includes a free end curved hook 12 which forms an opening or orifice 14 between the second rod 5 and the third rod 9. The curved hook 12 desirably is curved toward the second rod 5. The third rod 9 is positioned parallel to the first rod 4, but at least a portion of the second rod 5 and the third rod 9 are not parallel to each other.

The webbing hook 2 may be made of metallic material such as iron or aluminum or a strong plastic/polymer or wooden material capable of withstanding applied forces from a user during resistance band exercises (for example, at least 100 pounds of force).

Alternatively, the webbing hook 2, in accordance with an exemplary construction may include a metal insert (not shown) having a ridge with portions of the metal insert being made of steel or other suitable material. By way of example only, and not limitation, the metal insert may be a one-piece structure formed from relatively light gauge spring steel or the like sandwiched between a first covering layer (not shown) and a second covering layer (not shown) wherein the first covering layer and the second covering layer may each be formed of non-fragmenting polymer configured to substantially cover portions of the metal insert other than, for example, the metal ridge. This may make the webbing hook 2 strong and light in weight. In the event of relatively strong applied forces from a user, the non-fragmenting polymer and metal insert will not fragment into multiple pieces but will simply deform or be pierced.

The webbing hook 2 may be a part of the adjustable resistance band 100 which may comprise a strap 1 and one or more slots 3 each slot 3 having an opening 3*a* that is configured to receive a ridge 12 of the webbing hook 2. The slots 3 may be loops that are created by sewing or stitching, used interchangeably hereinafter, strap 1 onto itself, or a separate strap material onto the strap 1 at one or preferably a plurality of locations at defined intervals, as shown by stitching 20*a*. Said locations may be, for example, 2-6 cm apart and may be defined such that a notable amount of change in length and resistance from ringlet to ringlet is observed. Said slots 3 may be open top to bottom to receive the ridge 12 which may come out an opposite end of the slot to further secure the connection. Moreover, said slots 3 may be large enough to receive the ridge 12 without significant effort.

Further, each slot may have markings 30 that may be used to easily identify said slot from an overhead orientation when being used thus indicating the spacing intervals to the user for their reference.

Strap 1 may be secured to the webbing hook 2 by passing an end of the strap 1 through the enclosed window opening 10 and affixing said strap 1 back to itself through an affixing or stitching means such as reinforced machine sewing 20*b* or adhesive. Of course, it will be appreciated by a person or ordinary skill in the art that other ways of securing the webbing hook 2 to the strap 1 and of creating said slots may be achieved in light of this specification.

Figure 2A:
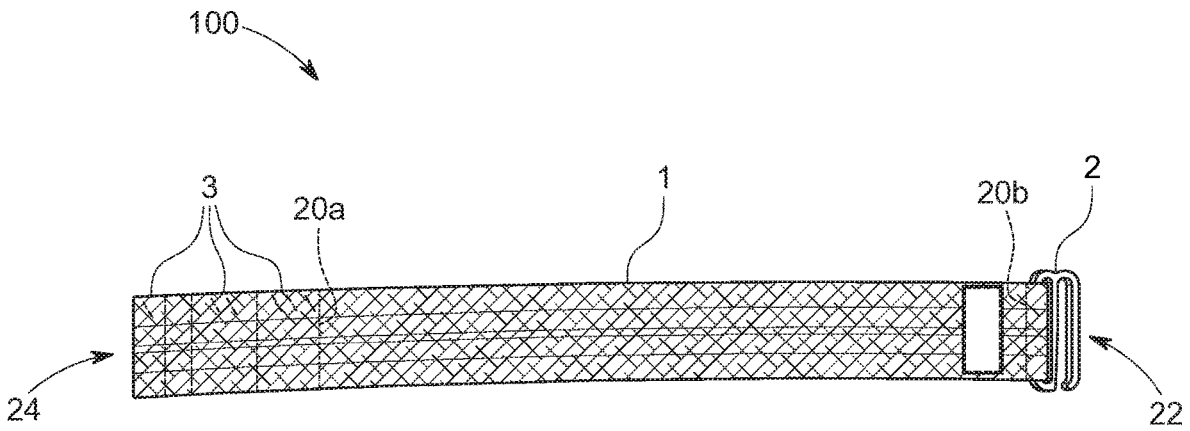
FIG. 2A shows a side view of aa adjustable resistance band in an open loop according to an exemplary embodiment of the present invention.
Figure 2B:
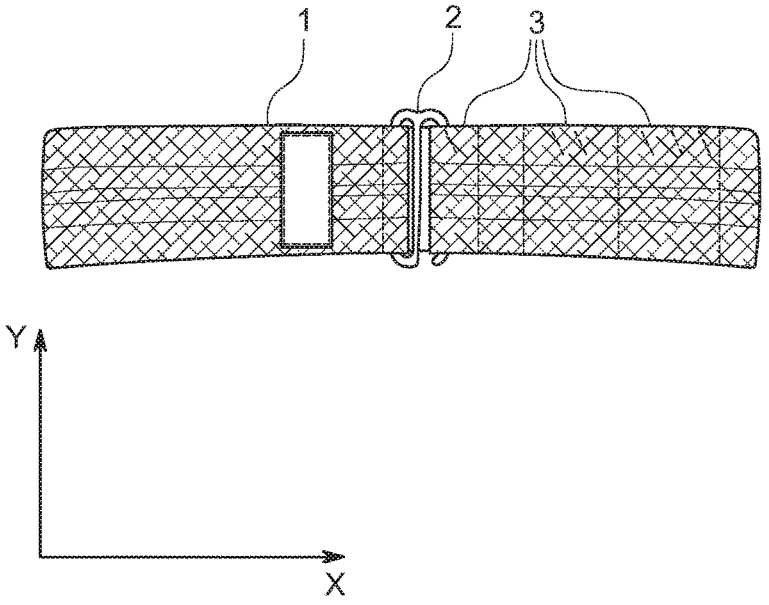
FIG. 2B shows a side view of an adjustable resistance band in a closed loop according to an exemplary embodiment of the present invention.
Figure 3:
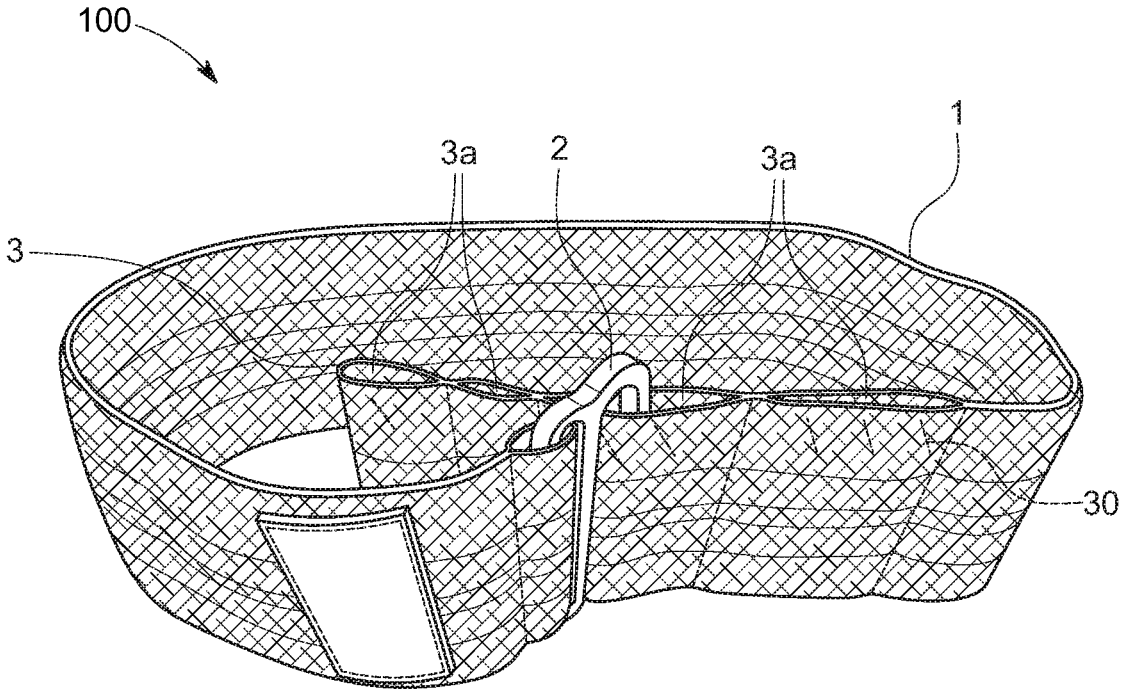
FIG. 3 illustrates perspective view of an adjustable resistance band in a closed loop according to an exemplary embodiment of the present invention.

FIGS. 2A and 2B show the adjustable resistance band 100 in an open loop configuration and a closed loop configuration respectively FIG. 3 shows a perspective view of said adjustable resistance band 100. As shown in these figures, the strap 1 of the adjustable resistance band 100 may be modular and may be elastic or substantially elastic, having a first proximal end 22 and a second distal end 24. The webbing hook 2 may be attached to the strap 1 of the resistance band 100 at said proximal end 22.

The strap 1 may preferably be made substantially of elastic material. For example, in an embodiment, the strap 1 may be made of a blend of materials which includes cotton in addition to an elastic material for increased comfort and structural integrity. This may be achieved by a machine weaving cotton fibers and elastic fibers into a fabric blend. This improves the comfort of the band, which is important for using on bare skin, certain body parts and certain populations of people such as elderly, injured and diseased. Adding the cotton also prevents ripping as elastic by itself is prone to ripping. Lastly, this fabric does not roll up or bunch up during use the way that plastic or elastic bands do. Different strengths of the band may be achieved by modulating the density or thickness of the fabric as well as the width of the band.

The adjustable resistance band 100 has an innovative design through the incorporation of slots 3 along the length (X-axis direction) of the adjustable resistance band 100 such that the amount of resistance exerted on the user by the strap 1 can be varied by inserting the ridge 12 of the webbing hook 2 into a different slot opening 3*a* along the length of the adjustable resistance band 100. This adjustment and securing means could progress along the length of the strap iso that the webbing hook may be secured at one or more points along the strap 1 and provide for a varying in length of the strap 1 to cause a corresponding change in resistance relative to the spatial dimensions of exercise the user is working with. For example, the amount of resistance that a user will be working against will be greater when the strap is adjusted to a closed loop with a smaller diameter and vice versa.

Figure 7A:
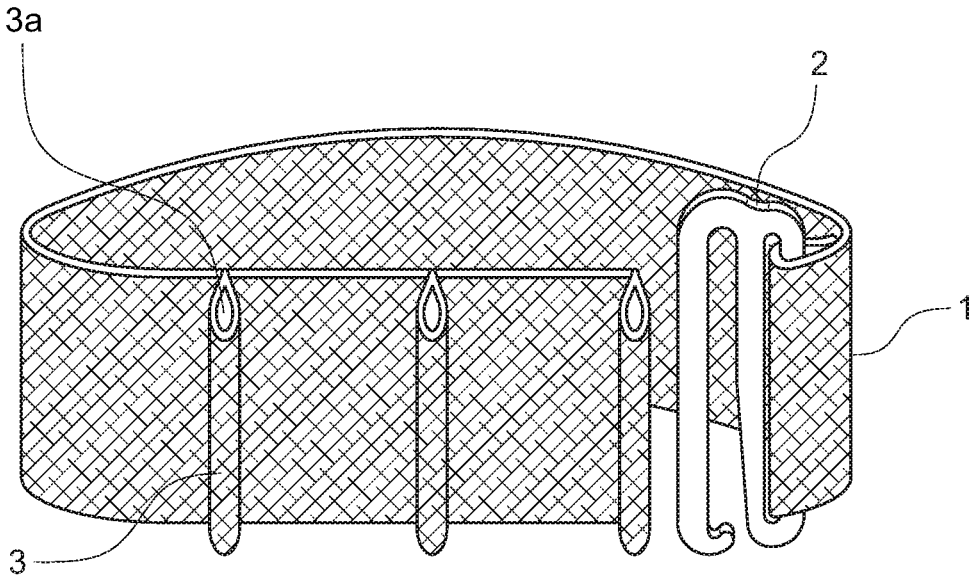
FIG. 7A shows a perspective view of an exemplary embodiment of the adjustable resistance band.
Figure 7B:
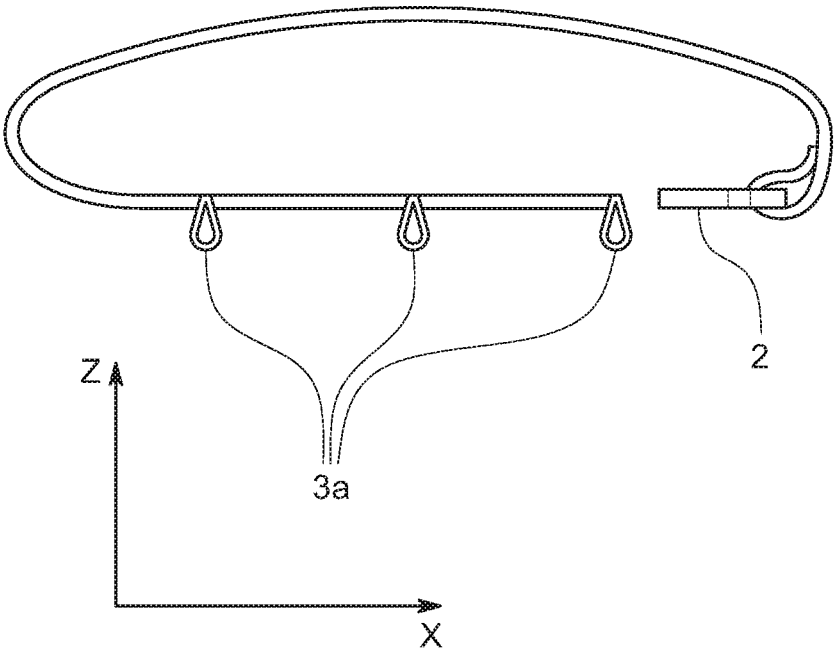
FIG. 7B shows a top view of an exemplary embodiment of the adjustable resistance band.

In an alternative embodiment of the present invention, the slots of the band 100 may be provided in a different configuration as shown in FIG. 7A and FIG. 7B. The slots 3 may be dimensioned to be substantially perpendicular (Z-axis) to a longitudinal profile (X-axis) of the adjustable resistance band 100. Herein, each slot 3 may be made of a material, for example a material separate from the strap 1, that may be stitched on both ends of said material to a portion of the strap 1 to create a defined shape and size of the slot 3.

Figure 5:
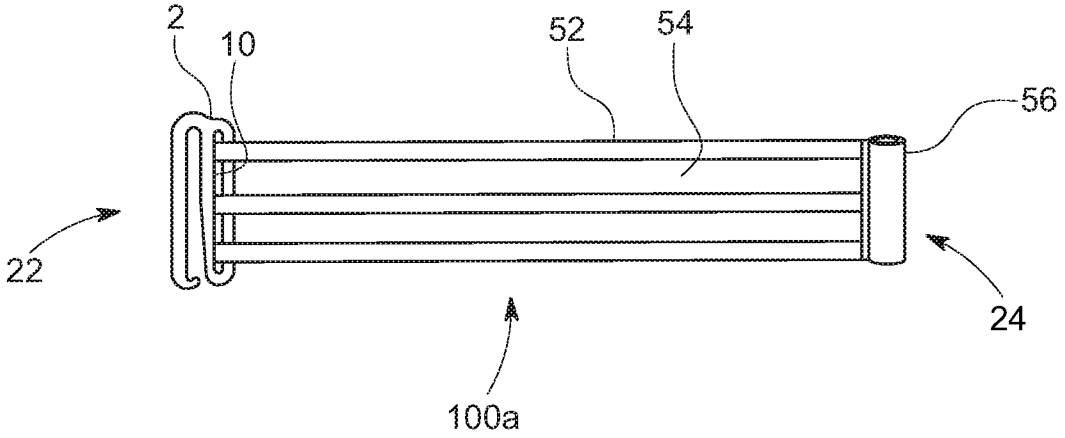
FIG. 5 shows a side view of an exemplary embodiment of the adjustable resistance band.

Further, as shown in FIG. 5, strap 1 may be realized in a different configuration in which one or a plurality, but preferably a plurality, of rubber tubes 52 separated by open space 54 may be attached to a webbing hook 2 at proximal end 22 and to a slot at a distal end 24. The rubber tubes 52 may be passed through the enclosed opening 10 of the webbing hook 10 and may end or be affixed to a slot 56 at a distal end, said handle being a tube or loop of strong material (such as a strong fabric or plastic) configured to receive a ridge 12 of the webbing hook.

Figure 6:
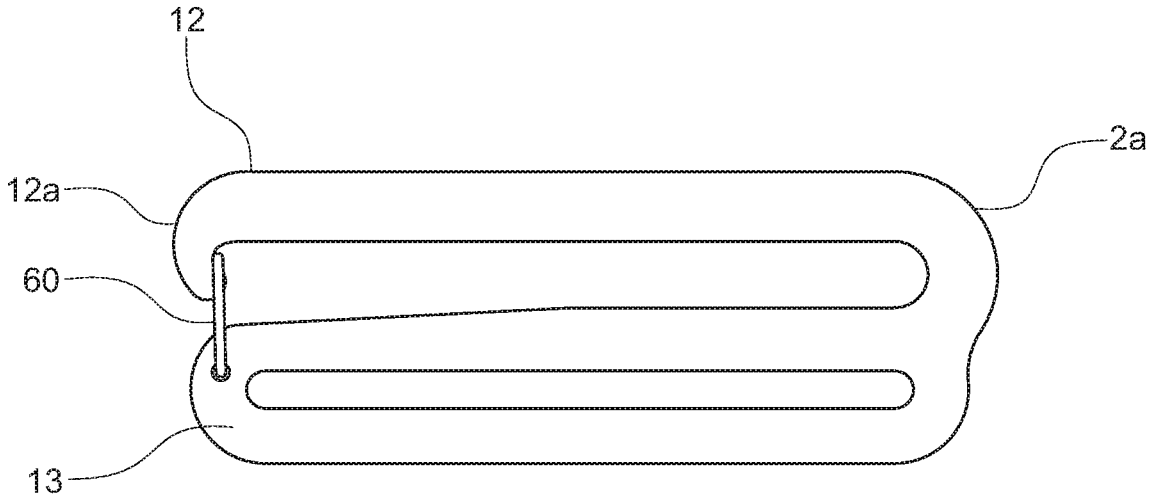
FIG. 6 shows a side view of an exemplary embodiment of the webbing hook.

Further, as shown in FIG. 6, a webbing hook 2*a* may have a lock 60, and preferably a spring biased lock, disposed on one end of the connecting segment 13, and adjustable to be received and preferably locked into place by a proximal end 12*a* of the ridge 12. Herein, after insertion of the ridge 12 into a slot 3, the lock 60 may engage the proximal end 12*a* of the ridge 12 to confine the slot 3 and prevent the webbing hook 2*a* from being accidentally removed from the slot 3.

Method of Using an Adjustable Resistance Band

This adjustable resistance band 100 may be designed to help users activate, strengthen, and/or bring awareness to important muscles in the body, (including the gluteal muscles, thigh muscles, latissimus dorsi, and abdominal muscles, torso, and/or otherwise muscles) through a plurality of specific exercise drills. The presence of said slots 3 interspersed along the length of the opened strap 1 increases the number of configurations in which it may be used.

Further the adjustable resistance band 100 may easily be converted from a non-looped band system (a straight strip with two ends) into a closed-loop system (closed circle) through the receipt of the ridge 12 of the webbing hook 2 by an opening 3*a* of the slot.

In an exemplary embodiment, the adjustable resistance band 100 may be used during physical activities where the user may demonstrate valgus knee collapse (e.g., squats, jumping and landing exercises, etc.). The feedback provided by the strap 1 instructs the user to move their knees away from a valgus position toward a more optimal position such as a neutral or varus position. Maintaining a neutral or varus knee position against resistance may strengthen the muscles of the hips while training the body for improved biomechanics.

Figure 4A:
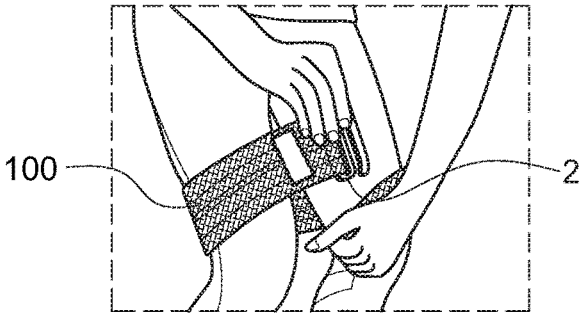
FIG. 4A is a sketch showing a use of the adjustable resistance band according to an embodiment of the present invention.

It should be noted that the adjustable resistance band may be used to address lower extremity alignment issues other than valgus knee collapse. FIG. 4A demonstrates how a user may hold the band in order to secure the invention to their body for use. Further, FIG. 4B demonstrates an exercise wherein the band 100 may be adjusted to a tighter or smaller loop setting for more resistance. The webbing hook 2 may be inserted into one of the slots 3. This exercise may be performed be moving the knees apart and then back together, also called abduction with external rotation, thereby strengthening muscles of the hips.

Figure 4B:
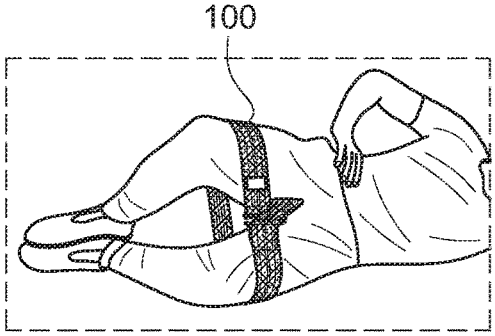
FIG. 4B is a sketch showing another use of the adjustable resistance band according to an embodiment of the present invention.
Figure 4C:
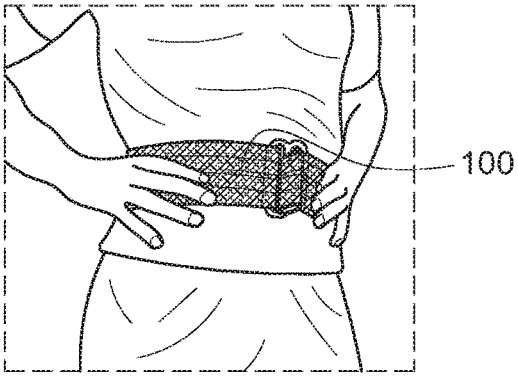
FIG. 4C is a sketch showing a use of the adjustable resistance band according to an embodiment of the present invention.
Figure 4D:
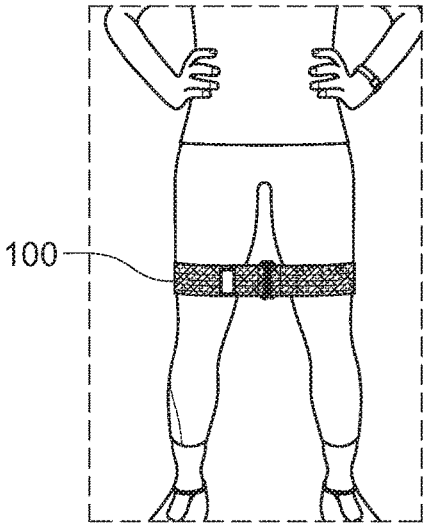
FIG. 4D is a sketch showing a use of the adjustable resistance band according to an embodiment of the present invention.

The webbing hook 2 may then be removably secured to a slot 3 by passing the ridge 12 of the webbing hook through a slot 3 which provides for an optimal initial resistance to the user. The user may be in a horizontal position as shown in FIG. 4B.

The user may repetitively increase, and decrease said distance between the thighs during which the adjustable resistance band will provide a counteractive resistance to the legs as they move apart. Said counteractive resistance aids in strengthening muscles of the hips, legs and torso. During the exercise movements, the user may easily and safely adjust the band via the use of the ridge 12 of the webbing hook 2 which may be removed from one slot 3 and placed into another slot 3 without significantly changing the user's current stance or overall position.

In addition to being used in exercises for strengthening the hip and leg muscles, the adjustable resistance band 100 lends itself to being used around the torso unlike existing bands which can be extremely challenging and laborious to get onto your torso, and thus is not known to be used for that purpose. This may help the user perform drills to strengthen muscles of the torso (including for example transverse abdominis, internal obliques, external obliques, and the diaphragm muscle.) for improved breathing or for core strength. The quick webbing hook technology allows the adjustable resistance band 100 to be to be put on the body and taken off fast and safely.

Further, the adjustable resistance band 100 may be placed around the user's abdominal section or torso starting from an open loop configuration in which said adjustable resistance band may be placed around the abdomen or torso a back of the user and then tightened into a closed loop configuration at the front of the user using said ridge 14 of the webbing hook 2 which is placed into a slot 3 to provide an initial resistance. Herein, by securing the resistance band around the torso near or at the location of the diaphragm, the user may activate or strengthen their breathing muscles including the diaphragm and intercostal muscles. This strengthening may be achieved by creating resistance to the expansion and collapse of the thorax or abdomen during breathing which may improve the user's awareness and the strength of these muscles.

Moreover, the adjustable resistance band 100 may be used in weightlifting. As a weightlifting belt, this band may help the muscles of the trunk or core engage more without taking all of the load, which in turn teaches them to become stronger and more supportive. The combination of the elastic nature and the ability to easily hook it around the waist like a belt allows this unique functionality. More specifically, current products may act as a fixed support to which the user may fully rely on to support their body during weightlifting. The body has muscles that are naturally designed to support the body and spine. If these muscles are not required to do their job during weightlifting, they may not get stronger. Only the muscle that creates the lifting action will get stronger. This may be dangerous as it may create imbalances in the body and may make the body more susceptible to injury. The band 100 may thus offer an alternative approach providing a relatively slight amount of support in addition to improved body awareness so that the user may actually strengthen and enhance the use of their intrinsic support muscles.

In the open loop configuration as shown in FIG. 2A, the adjustable resistance band 100 may be adapted with a handle (not shown) at the distal end, said handle being received by an opening 3*a* for use in so called band pull-apart/chest exercises wherein the open loop resistance band may be pulled apart without bending the elbows until the band touches the user's chest. Herein there may not be a need to change devices from a closed loop resistance device to a separate open loop resistance device, thus increasing time and cost savings. Moreover, other exercise may be performed in the open loop configuration such as pulling the band 100 apart with both arms when is it spatially situated above the user's head or behind the user's head or back. Even further, while a user lies flat on his back, he may raise one leg such that it is substantially perpendicular with the other leg. A mid portion of the band 100 in the open loop configuration may be placed on the sole of the raised leg and the band 100 may be pulled towards the chest to stretch the hamstring muscles and other leg and hip muscles.

In yet another embodiment, a hook and eye closure (not shown) may be employed. Herein the slots 3 may be sealed on all sides and the proximal end 22 of the band 100 may have one or more hooks attached thereto while one or more slots 3 on the distal end 24 may each have a corresponding number of eyes configured to receive the one or more hooks in order to form a closed loop band.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiment or enumerated variation. Many modifications, variations and other embodiments will come to the minds of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. An adjustable resistance band comprising:

a strap made of elastic material, the strap having a proximal end and a distal end, the strap including a plurality of slots formed only near the distal end of the strap, wherein each slot of the plurality of slots is formed by two overlapped portions of elastic material and each of the slots is defined by at least one line of a plurality of lines of sewing or stitching, each line of the plurality of lines of sewing or stitching spaced-apart from the other and positioned transversely across the two portions of elastic material to connect the two overlapping portions of elastic material together to define each of the slots, an opening formed through each of the slots via unconnected portions of each of the slots; and a webbing connector including an enclosed window opening formed by a first rod spaced-apart from a second rod, the first rod and the second rod connected together by first and second ends, respectively, the first rod having a length and a symmetrical width, and the second rod having a length and a tapered width, a third rod connected to the webbing connector via a third end connected to the second end and spaced-apart from the second rod, the third rod including a free end forming a curved hook which forms an opening between the second rod and the third rod, wherein excluding the curved hook, the third rod is positioned parallel to the first rod, wherein the proximal end of the strap extends through the enclosed window of the webbing connector and the portion of the proximal end is connected via sewing or stitching to the strap, and wherein the third rod of the webbing connector is configured to be positioned through the opening in at least one slot of the plurality of slots in a distal portion of the strap near the distal end thereof to adjust a working size of the adjustable resistance band.

2. The adjustable resistance band of claim 1, wherein at least a portion of the second rod is not parallel to the third rod or to the first rod.

3. The adjustable resistance band of claim 1, wherein the two portions of overlapping elastic material forming each slot of the plurality of slots are configured to be parallel to a longitudinal profile of the adjustable resistance band.

4. The adjustable resistance band of claim 1, wherein no slot of the plurality of slots is formed at or near the proximal end of the strap.

5. The adjustable resistance band of claim 1, wherein the curved hook of the third rod of the webbing connector includes a lock, and one end of the lock is connected to a portion of the first end, and an opposite end of the lock is adjustable to be releasably locked into place by the curved hook in order to prevent the third rod and the curved hook thereon of the webbing connector from being accidentally withdrawn from one slot of the plurality of slots through which the third rod is positioned during exercise.

6. The adjustable resistance band of claim 1, wherein the adjustable resistance band is configured to be used in an open loop configuration or in a closed loop configuration.

7. The adjustable resistance band of claim 1, wherein at least two slots of the plurality of slots comprise different widths relative to each other.

8. The adjustable resistance band of claim 1, wherein the second rod tapers from a wider portion thereof near the second end to a narrower portion thereof near the first end.

* * * * *